US008888510B2

(12) United States Patent
Webb

(10) Patent No.: US 8,888,510 B2
(45) Date of Patent: Nov. 18, 2014

(54) SINGLE-PIECE SHIELD CAN

(75) Inventor: Michael J. Webb, Scotts Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/610,750

(22) Filed: Sep. 11, 2012

(65) Prior Publication Data

US 2014/0073186 A1 Mar. 13, 2014

(51) Int. Cl.
*H01R 12/00* (2006.01)
*H01R 12/50* (2011.01)

(52) U.S. Cl.
CPC ..... *H01R 23/70* (2013.01); *H01R 23/72* (2013.01); *H01R 23/727* (2013.01); *H01R 23/7063* (2013.01)
USPC ..... 439/76.1; 439/607.41

(58) Field of Classification Search
CPC .... H01R 23/70; H01R 23/7063; H01R 23/72; H01R 23/727
USPC ..... 439/76.1, 607.41, 607.46
See application file for complete search history.

(56) References Cited

U.S. PATENT DOCUMENTS

| | | | | |
|---|---|---|---|---|
| 5,797,771 | A * | 8/1998 | Garside | 439/607.46 |
| 5,810,620 | A * | 9/1998 | Kobayashi et al. | 439/607.41 |
| 7,845,983 | B2 * | 12/2010 | Kawada et al. | 439/607.46 |
| 7,955,132 | B2 * | 6/2011 | Luo | 439/607.41 |
| 8,007,317 | B2 * | 8/2011 | Su et al. | 439/607.46 |

* cited by examiner

*Primary Examiner* — Khiem Nguyen
(74) *Attorney, Agent, or Firm* — Kilpatrick Townsend & Stockton LLP

(57) ABSTRACT

Shields for connector adapters that may provide for easy assembly, good RF isolation, and low spacing tolerance. One example may include integrated location features to align a shield to a printed circuit board. The shield may be formed of a single piece of metallic or otherwise conductive material, such as stainless steel.

20 Claims, 8 Drawing Sheets

SINGLE-PIECE SHIELD CAN

BACKGROUND

The numbers and types of electronic devices available to consumers have increased tremendously the past few years, and this increase shows no signs of abating. Devices such as portable computing devices; tablet, desktop, and all-in-one computers; cell, smart, and media phones; storage devices; portable media players; navigation systems; monitors and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power.

The connector receptacles in a signal path may be different types of connector receptacles. In these situations, a cable adapter having connectors compatible with two connector types may be used as part of a signal path. For example, a signal path may begin at a first connector receptacle of a first type, which may be located in a first electronic device. A first cable having a first insert of the first type may be inserted into this connector. The cable may include a second insert of the first type, which may be inserted into a second connector receptacle of the first type located at a first end of the cable adapter. The second end of the cable adapter may include a connector insert of a second type. This may be inserted into a first connector receptacle of the second type located on a second electronic device. The cable adapter may further include electronic circuitry placed on a printed circuit board.

To reduce costs of such cable adapters, it may be useful for them to be easy to assemble. It may also be useful to provide shielding for the electronic circuitry such that it does not generate RF (Radio Frequency) interference that could degrade performance of the first or second electronic devices. In order to be able to reliably manufacture the cable adapters, it may be useful to provide shields having a low spacing tolerance.

Thus, what is needed are shields for connector adapters that may provide for easy assembly, good RF isolation, and have a low spacing tolerance.

SUMMARY

Accordingly, embodiments of the present invention may provide shields for connector adapters that may provide for easy assembly, good RF isolation, and have a low spacing tolerance. An illustrative embodiment of the present invention may include integrated location features to align a shield to a printed circuit board. The shield may be formed of a single piece of metallic or otherwise conductive material, such as stainless steel. This stainless steel may be plated with tin or other material to improve its solderability.

An illustrative embodiment of the present invention may provide a shield for a connector adapter that provides for a simple assembly. Specifically, the shield may be slid over a printed circuit board. Two integrated location features, a first notch on a first side and a second notch on an opposing second side, may accept first and second sides of the printed circuit board. The shield may then be slid over the printed circuit board until a back edge of the printed circuit board is fit through a third integrated location feature, a first cutout on a back side of the shield. A strain relief attached to the printed circuit board may fit through a central opening in the back side of the shield. A finger on the shield may snap down once the strain relief passes, thereby locking the shield in place relative to the printed circuit board.

An illustrative embodiment of the present invention may provide a cable adapter. The cable adapter may include a printed circuit board. The printed circuit board may include circuitry to read from or write data to a device, such as a camera, memory, media player, or other type of device. The printed circuit board may have a front edge to connect to a first connector. The first connector may be a connector plug or insert, or it may be a connector receptacle. A back edge of the printed circuit board may connect to a first end of a cable. A second end of the cable may connect to a second connector. The second connector may be a connector plug or insert, or it may be a connector receptacle.

A shield may be placed over the printed circuit board. The shield may be five-sided, where a sixth side is open. The open side may be positioned against a back side of the first connector such that the sixth side is covered by the back side of the connector. The shield may have a first side and a second side, the first side opposing the second side, and back side, the back side adjacent to the first and second sides. Notches in the first and second sides may accept first and second edges of the printed circuit board. A cutout in a back of the shield may accept a back edge of the printed circuit board. The notches and cutout may be soldered to plated areas on the printed circuit board, which may be ground contacts. A strain relief may fit in a central opening in the back side of the shield. A housing may be placed over the first connector and the shield.

Another illustrative embodiment of the present invention may provide a method of manufacturing a cable adapter. This embodiment may provide attaching a first connector to a first end of a cable. A housing, shield, and strain relief may be slid over a second end of the cable. The second end of the cable and the strain relief may be attached to a printed circuit board, which may further be connected to a second connector. The shield may then be fitted over the printed circuit board. In one example, this may be done by sliding the shield over the printed circuit board such that a first edge of the printed circuit board fits in a first notch on a first side of the shield and a second edge of the printed circuit board fits in a second notch on a first side of the shield, and continuing to slide the shield over the printed circuit board such that a third edge of the printed circuit board fits in a first cutout on a third side of the shield. The housing may be slid over the shield and the second connector.

Another illustrative embodiment of the present invention may provide a shield for a cable adapter. The shield may include a first notch on a first side and a second notch on a second opposing side. The shield may further include a first cutout on a back side, the back side adjoining the first side and the second side, and an opening on a front side. The back side of the shield may include a central opening such that a portion of the first cutout is on a first side of the central opening and a second portion of the first cutout is on a second side of the central opening.

While embodiments of the present invention are particularly well-suited to cable adapters, other embodiments of the present invention may be used to improve other types of electrical components. For example, an electronic device that does not include a cable, but is limited to a connector and a printed circuit board surrounded by a shield may employ embodiments of the present invention. For example, a wireless adapter on a printed circuit board encased by a shield and optionally having a connector receptacle (or connector receptacle) may be realized consistent with embodiments of the present invention.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
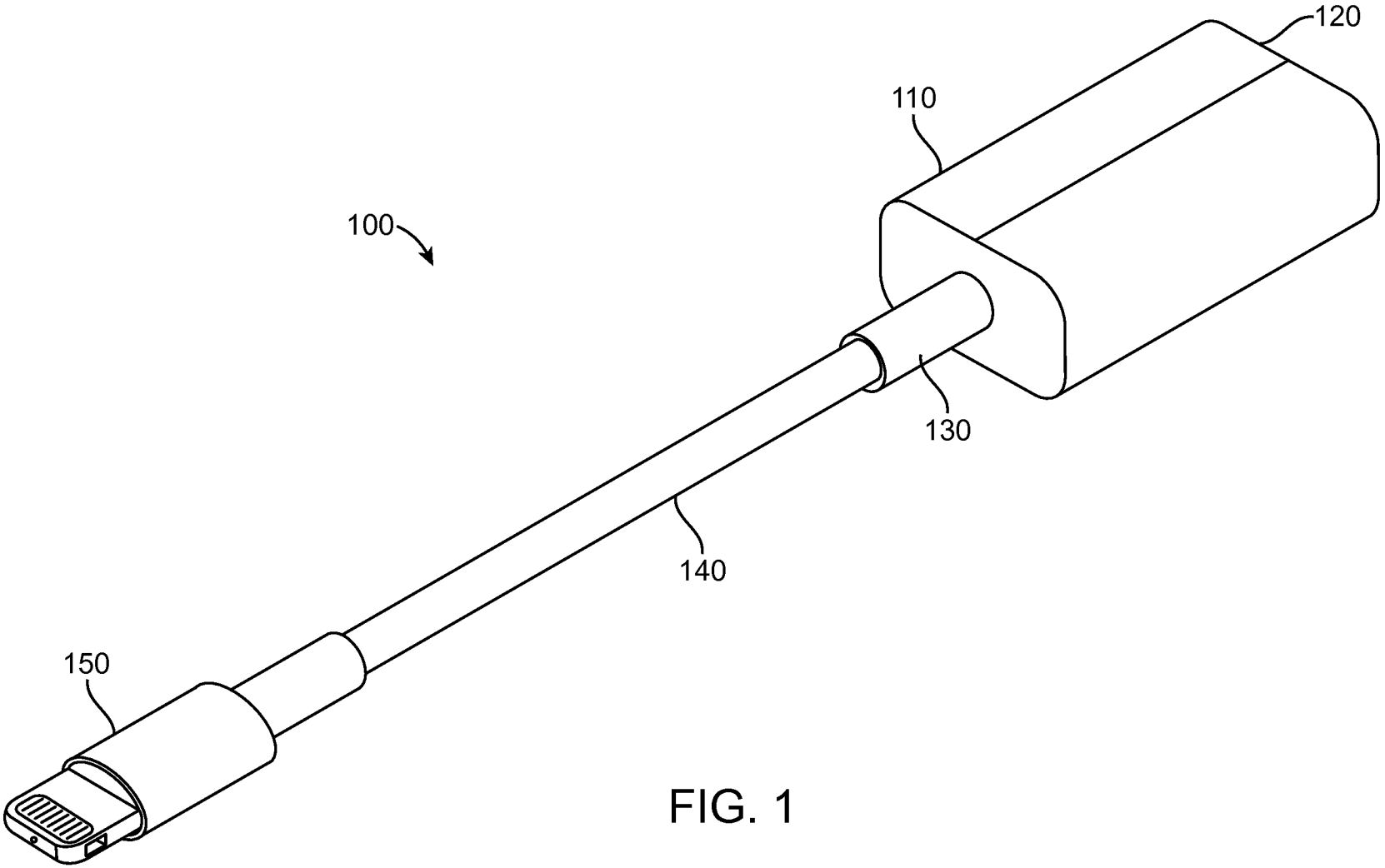
FIG. 1 illustrates a cable adapter according to an embodiment of the present invention.

FIG. 1 illustrates a cable adapter according to an embodiment of the present invention. Cable adapter 100 may include housing 110 having an opening (not shown) for connector receptacle 120. Cable 140 may provide electrical pathways between components located housing 110 and contacts on connector insert 150. Strain relief 130 may protect cable 140 from wear at the end of housing 110. This figure, as with the other included figures, is shown for illustrative purposes and does not limit either the possible embodiments of the present invention or the claims.

In various embodiments of the present invention, connector receptacle 120 may instead be a connector insert. Connector receptacle (or connector insert) 120 may be compatible with various signal interfaces, such as Universal Serial Bus (USB), High-Definition Multimedia Interface (HDMI), Digital Visual Interface (DVI), DisplayPort, Thunderbolt, or other types of interfaces. Similarly, connector insert 150 may instead be a connector receptacle. Connector insert 150 (or connector receptacle) may be compatible with the same or different signal interface as connector receptacle 120. These connector receptacles, such as connector receptacle 120, and connector inserts, such as connector insert 150, may also be connector inserts and connector receptacles such as those shown in co-pending U.S. patent application Ser. Nos. 13/607,366 and 13/607,439, both filed Sep. 7, 2012, which are incorporated by reference.

Again, embodiments of the present invention may provide cable adapters that are readily manufactured. An example is shown in the following figures.

Figure 2:
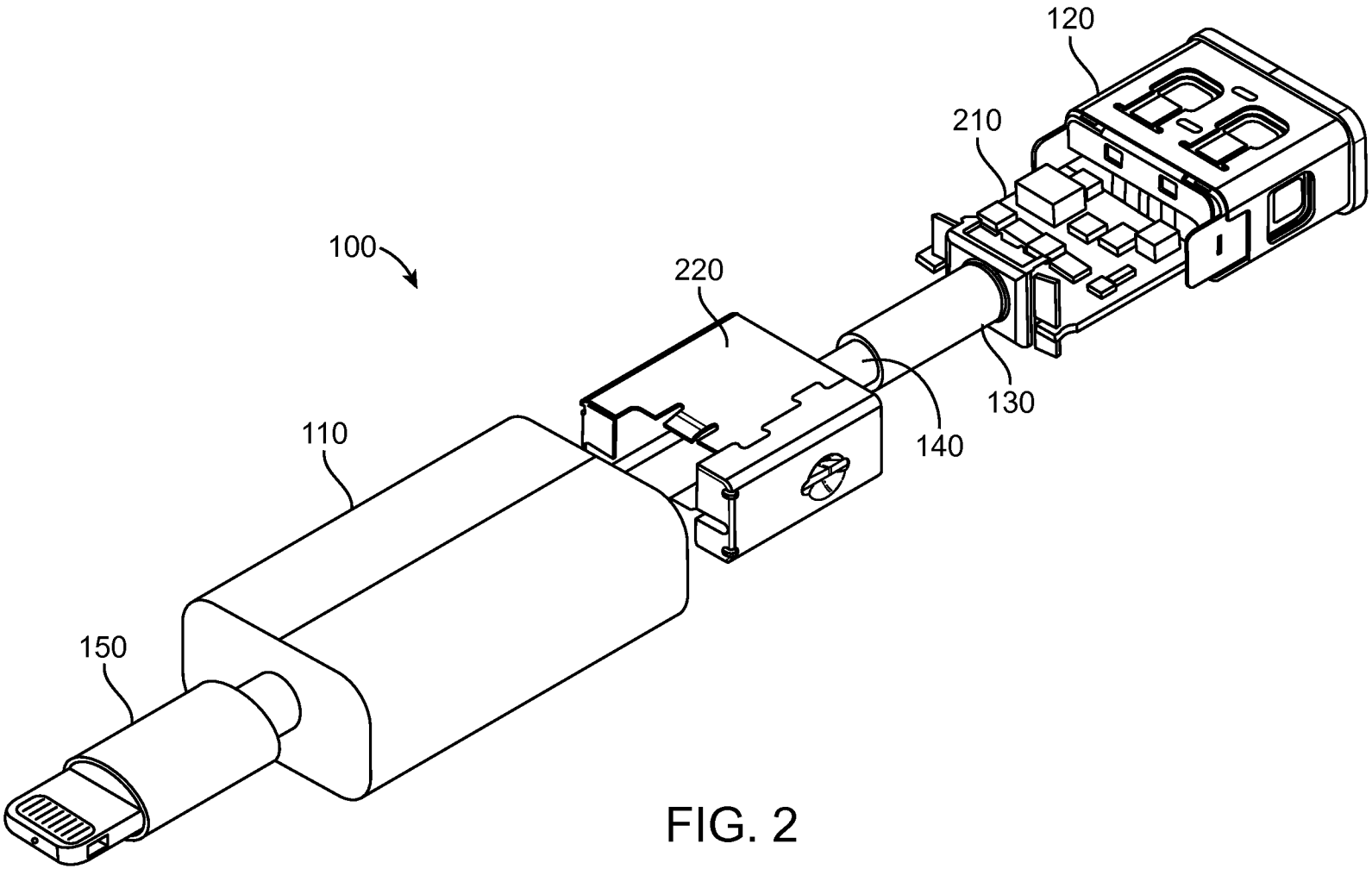
FIG. 2 illustrates components of a cable adapter during manufacturing according to an embodiment of the present invention.

FIG. 2 illustrates components of a cable adapter during manufacturing according to an embodiment of the present invention. In this example, connector insert 150 may be attached at a first end of cable 140. Housing 110 and shield 220 may be slid over a second end of cable 140. Strain relief 130 may also be slid over the second end of cable 140. Printed circuit board 210 may be attached to connector receptacle 120. That is, conductors in cable 140 may be attached to printed circuit board 210. In this configuration, strain relief 130, housing 110, and shield 220 may be captive on cable 140. Strain relief 130 may then be attached to printed circuit board 210.

Again, self-aligning features on shield 220 may allow for a very accurate placement of shield 210 relative to printed circuit board 210. An example is shown in the following figure.

Figure 3:
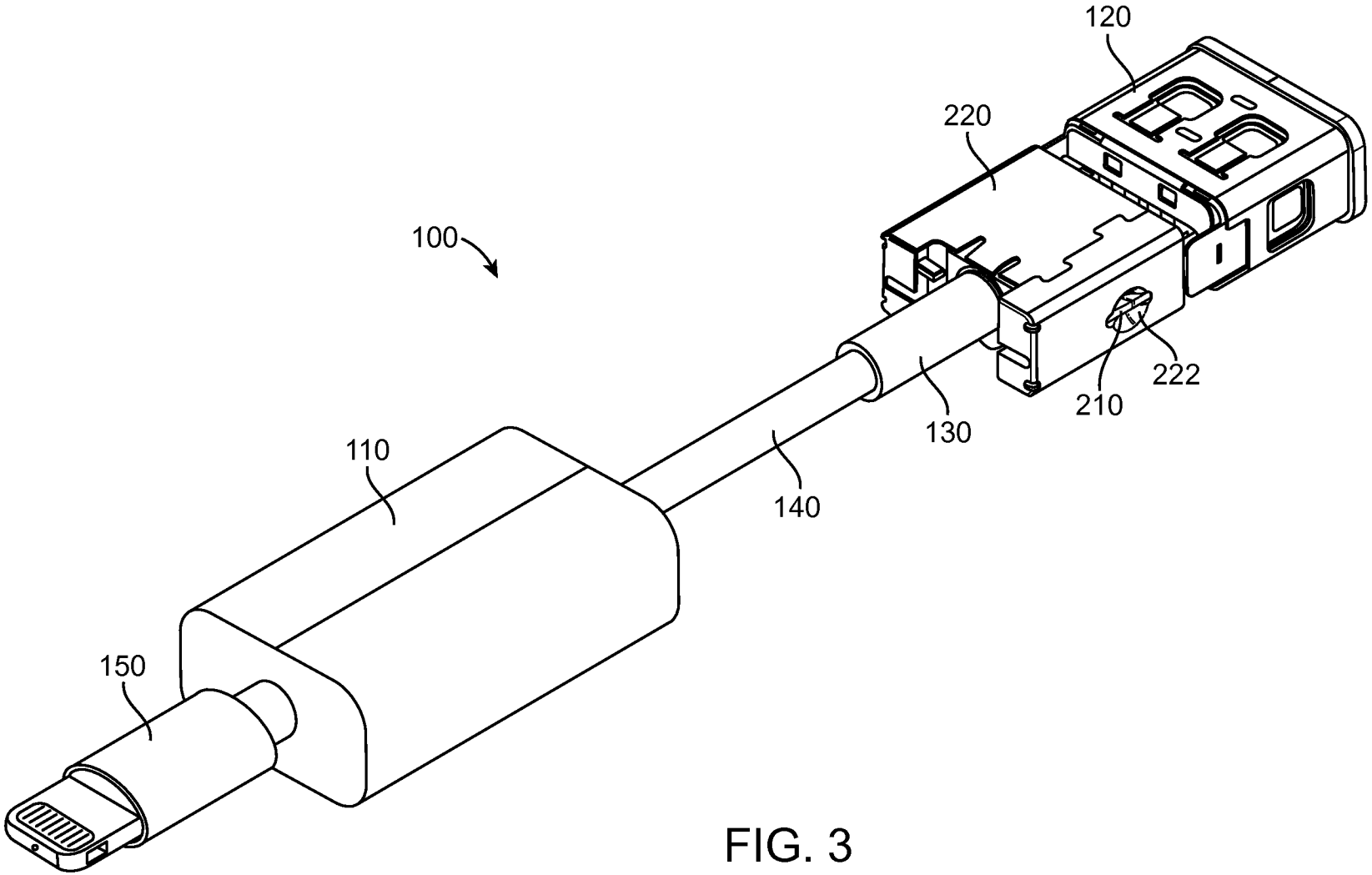
FIG. 3 illustrates components of a cable adapter during manufacturing according to an embodiment of the present invention.

FIG. 3 illustrates components of a cable adapter during manufacturing according to an embodiment of the present invention. Again, printed circuit board 210 may be attached to connector receptacle 120. Strain relief 130 and conductors in cable 140 may be attached to printed circuit board 210. Connector insert 150 may be attached to conductors in cable 140. Housing 110 may be temporarily moved out of the way towards insert 150 during this step of manufacturing.

Shield 220 may include notches 220 on each of two sides. Notches 220 may be arranged to accept edges of printed circuit board 210. These notches may accurately locate printed circuit board 210 relative to shield 220.

At this stage of assembly, shield 220 may be starting to be placed over printed circuit board 210. Once shield 220 is slid fully over printed circuit board 210, it may be desirable that shield 222 not retract backwards off printed circuit board 210. Accordingly, embodiments of the present invention may provide one or more fingers for shield 220. These fingers may be biased downward to deflect as a portion of strain relief 130 passes by. These fingers may then snap into place thereby locking shield 220 to printed circuit board 210. An example of this is shown in the following figure.

Figure 4:
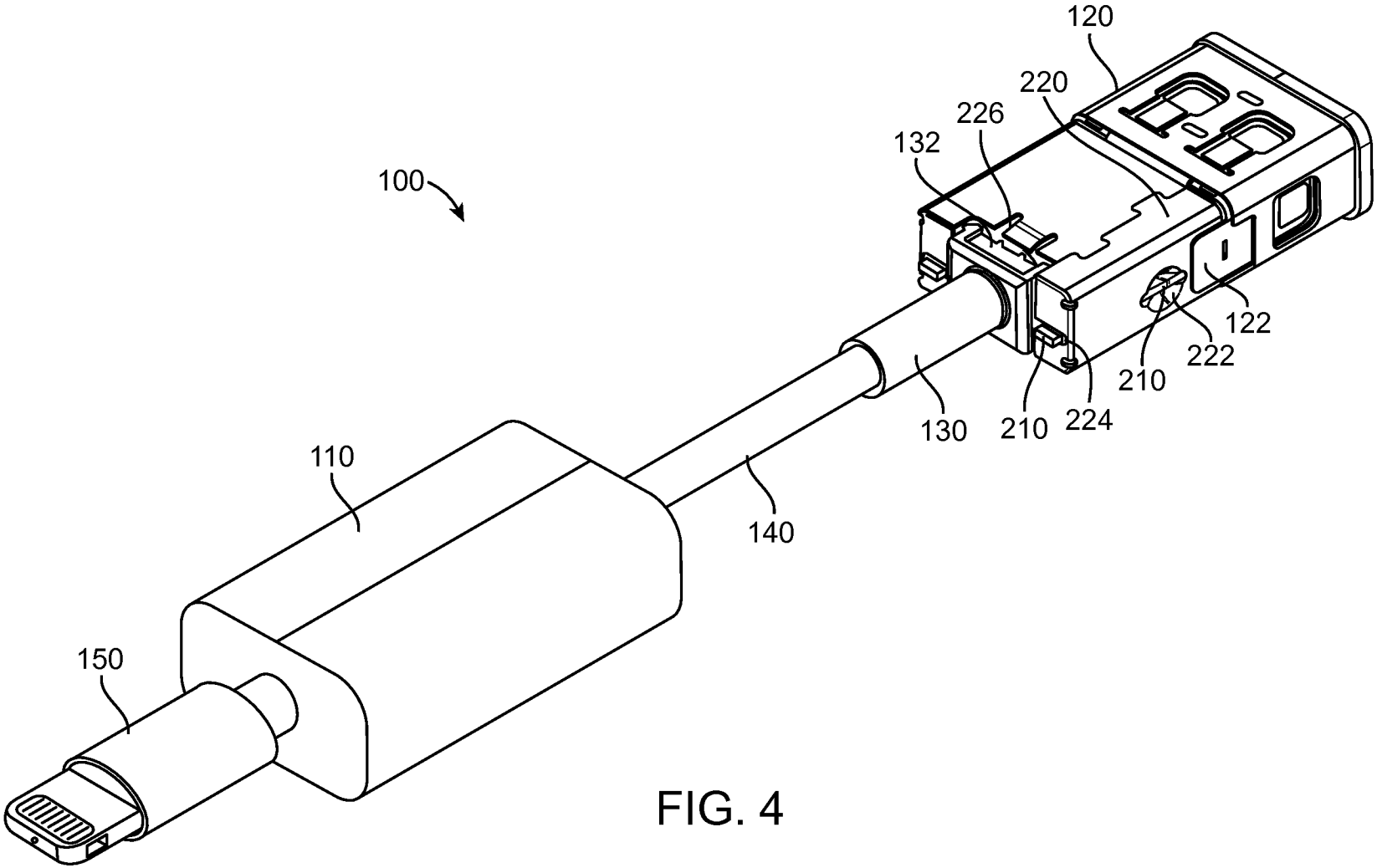
FIG. 4 illustrates components of a cable adapter during manufacturing according to an embodiment of the present invention.

FIG. 4 illustrates components of a cable adapter during manufacturing according to an embodiment of the present invention. Again, printed circuit board 210 may be attached to connector receptacle 120. Shield 220 may be further slid over printed circuit board 210 such that a back edge a printed circuit board 210 emerges through cutout 224 in a back of shield 220. Similarly, strain-relief portion 132 may pass through a central opening in a back of shield 220. Fingers 226 on a top (and possibly) bottom of shield 220 may deflect outward as strain-relief portion 132 passes through the central opening. These one or more inwardly-biased fingers 226 may then retract inward, thus preventing the backwards movement of shield 220. Fingers 226 may lock shield 220 into place relative to printed circuit board 210. Also, force from fingers 226 may push shield 220 up against a back of connector receptacle 120, thereby helping to secure shield 220 relative to connector receptacle 120. Notches 222 and cutout 224 in shield 220 may be soldered or otherwise secured to edges of printed circuit board 210. For example, edges of printed circuit board 210 may include ground contacts that are soldered to notches 222 and cutout 224.

An open end of shield 220 may now be covered by a back end of connector receptacle 120 thereby completing shielding around printed circuit board 210 and providing good RF shielding. Tabs 122 on connector 120 may be soldered or laser or spot welded to shield 220. At this point, housing 110 may be slid over shielding 220 and connector receptacle 120. Housing 110 may be glued or otherwise fixed to shielding 220 and connector receptacle 120.

Figure 5:
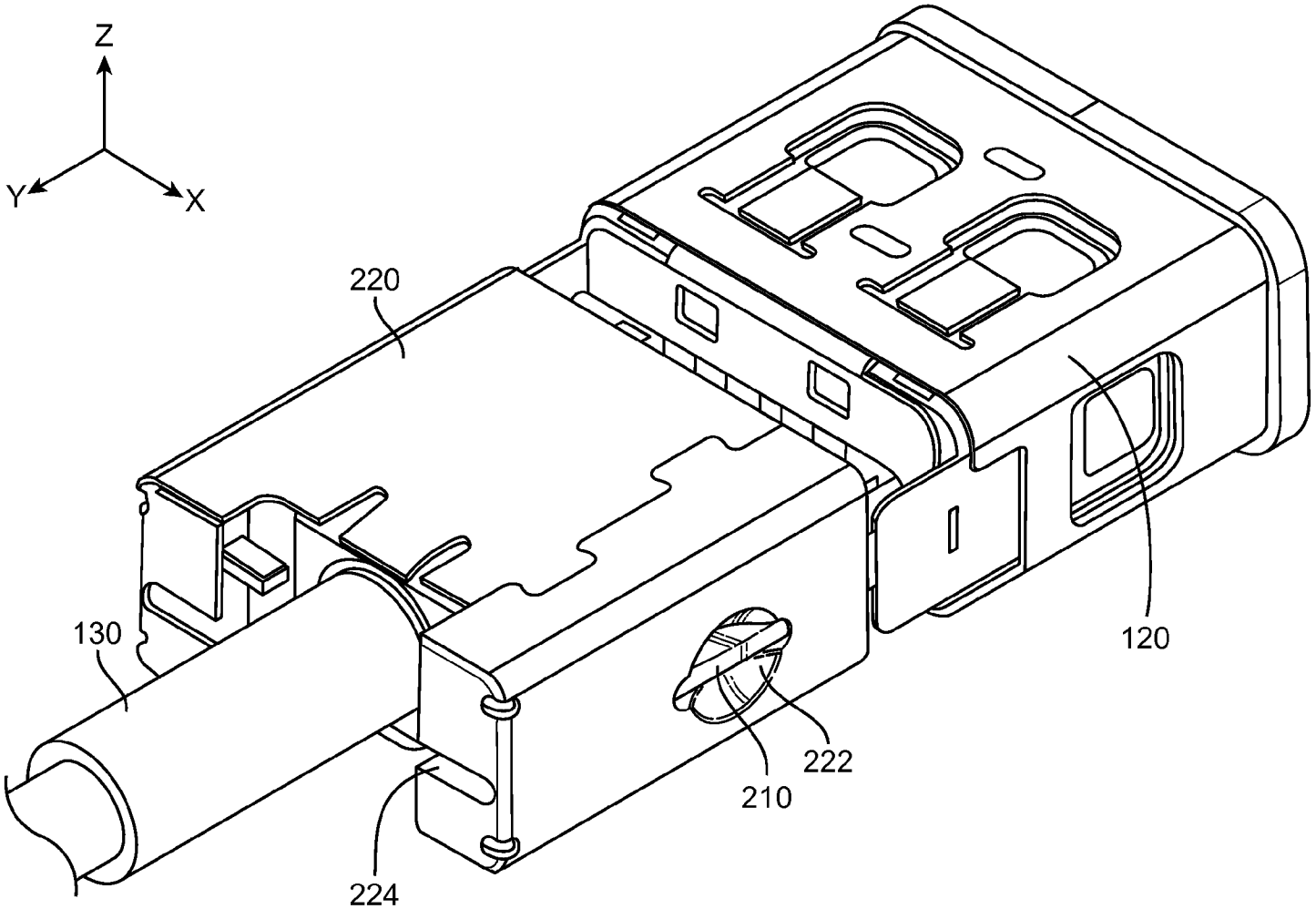
FIG. 5 illustrates a more detailed view of the self-aligning features of a shield according to an embodiment of the present invention.

FIG. 5 illustrates a more detailed view of the self-aligning features of a shield according to an embodiment of the present invention. Again, shield 220 may include notches 222 on each of two sides, while a back side adjacent to the two sides may include cutout 224 and a central opening for strain relief 130. An edge of printed circuit board 210 may fit in notches 222, thereby accurately aligning shield 220 to printed circuit board 210 in the X and Z directions.

In various embodiments of the present invention, shield 220 may be formed of a single piece of metal, such as stainless steel, copper alloy, or other material. This stainless steel or other material may be plated, for example with tin, to improve its solderability. Using a single piece of metal may reduce the number of seal lines as compared to joining multiple pieces of metal. This reduction in the number of seal lines may reduce RF leakage at the seals, thereby improving RF performance of the shield 220. Shield 220 may be stamped such that self-aligning features including notches 222 and cutout 224 are formed. After stamping, shield 220 may be bent and folded into the illustrated configuration.

Forming shield 220 in this manner may increase the dimensional repeatability of shield 220. For example, shields may conventionally be formed around a printed circuit board by placing a top shield over a top of the printed circuit board and a bottom shield under the printed circuit board. This configuration may mean that three error terms, specifically the thickness of the printed circuit board, and the height of each shield portion, are added to determine a tolerance for a height of the shield. Conversely, by folding a single piece of metal to form shield 220, the tolerance in the height of shield 220 is determined by the accuracy of the folds and bends performed in making the shield.

Figure 6:
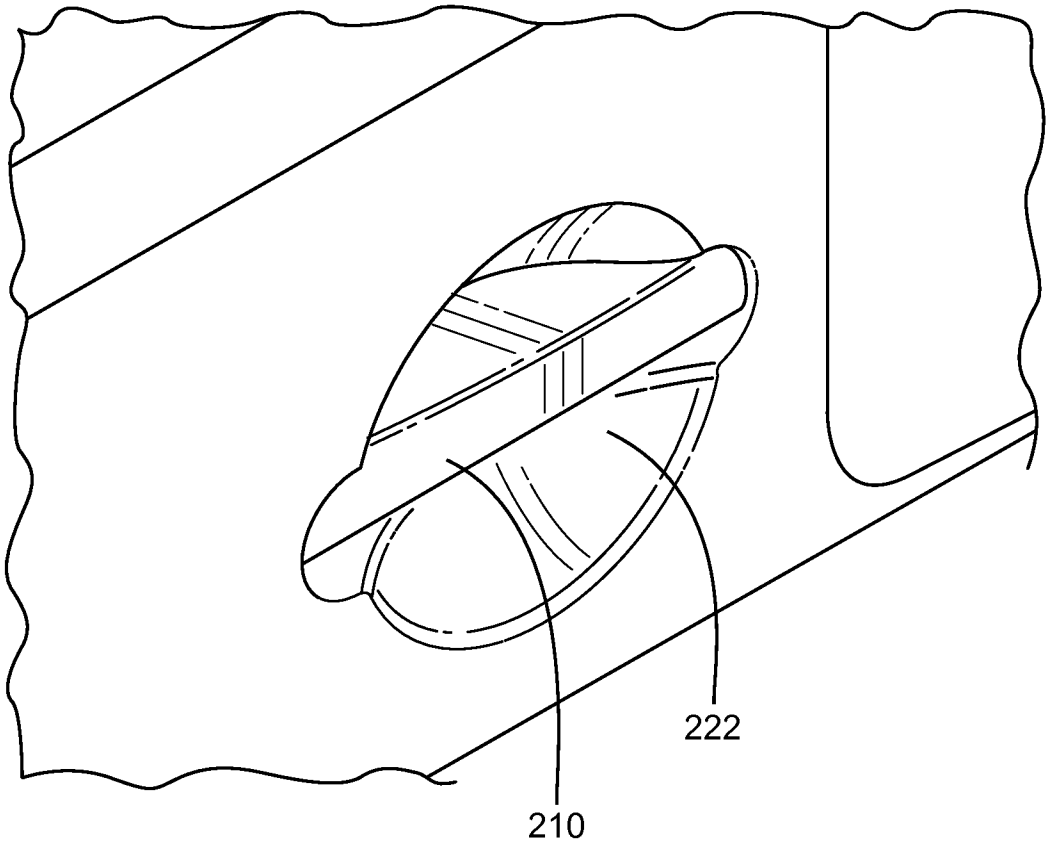
FIG. 6 illustrates a close-up view of a self-aligning feature for a shield according to an embodiment of the present invention.

FIG. 6 illustrates a close-up view of a self-aligning feature for a shield according to an embodiment of the present invention. Notches 222 may be formed by stamping a dimple including a groove to allow the passage of an edge of printed circuit board 210.

Figure 7:
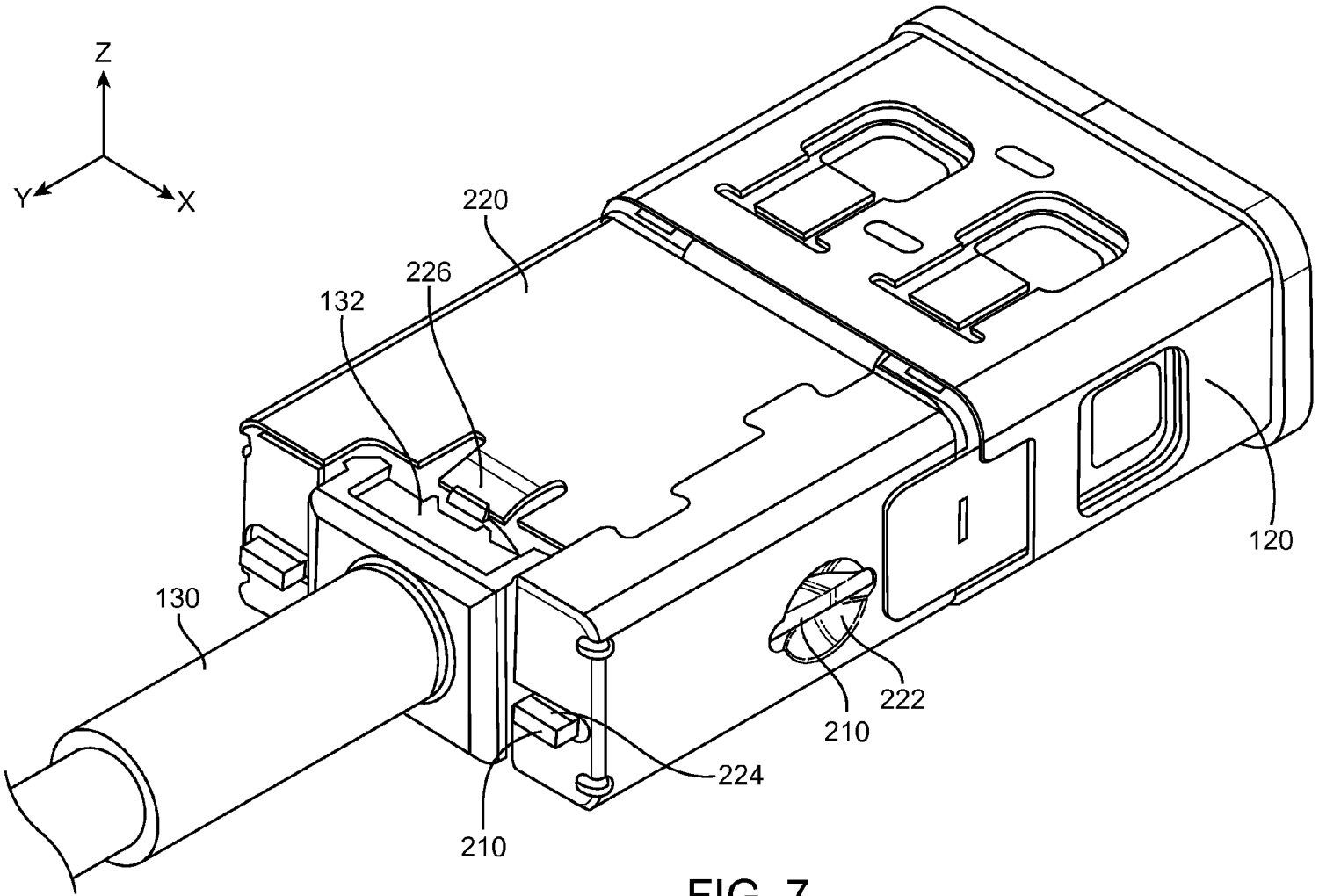
FIG. 7 illustrates a more detailed view of a shield according to an embodiment of the present invention.

FIG. 7 illustrates a more detailed view of a shield according to an embodiment of the present invention. In this figure, shield 220 may have moved such that it fully engages printed circuit board 210. Again, edges of printed circuit board 210 may be located in notches 222 and cutout 224. Strain-relief portion 132 may emerge from central opening in the back of shield 220. Finger (or fingers) 226 may snap down once strain-relief portion 132 passes. Fingers 226 may prevent shield 220 from sliding backwards off printed circuit board 210 and may secure shield 220 in place relative to printed circuit board 210 in the Y direction. In various embodiments of the present invention, this alignment may have a very low tolerance, that is, the placement of shield 220 to printed circuit board 210 may be very accurate. A front side opening of shield 220 may be covered by a back side of connector receptacle 120 thereby providing RF shielding on all sides for printed circuit board 210.

Figure 8:
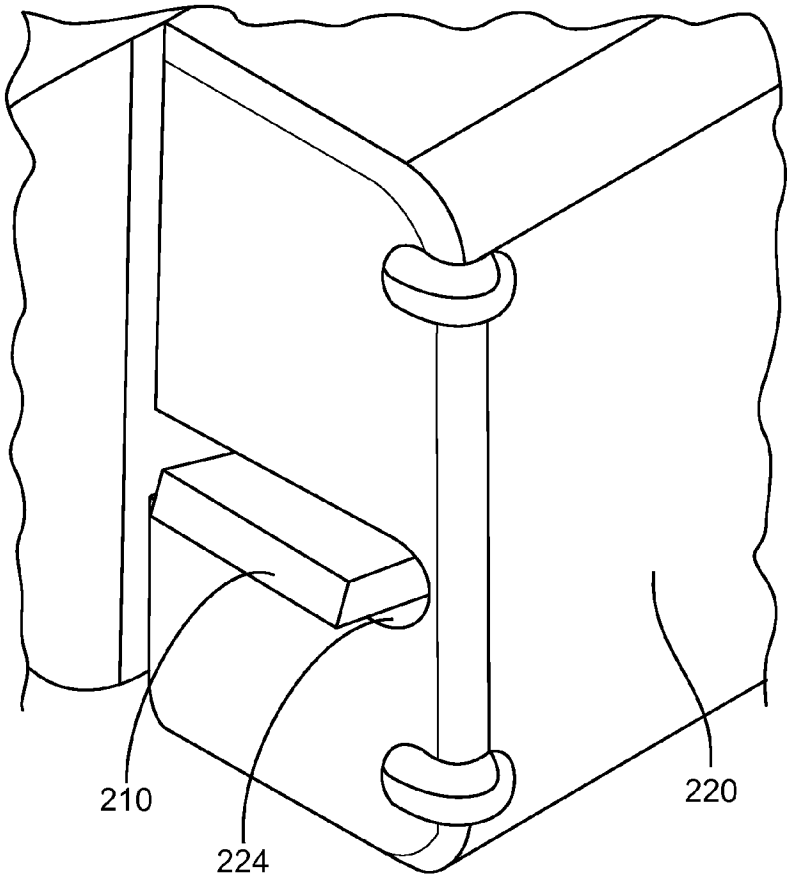
FIG. 8 illustrates a close-up view of a self-aligning feature for a shield according to an embodiment of the present invention.

FIG. 8 illustrates a close-up view of a self-aligning feature for a shield according to an embodiment of the present invention. In this figure, an edge of printed circuit board 210 may emerge from cutout 224 in shield 220. Cutout 224 may be formed by removing a notch from shield 220.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A cable adapter comprising:

a printed circuit board, the printed circuit board having plating on a first side edge, a second side edge, and a back edge, the first side opposing the second side and the back edge adjoining the first side and the second side;

a shield over the printed circuit board, the shield including:

a first notch soldered to the plating on the first side edge of the printed circuit board;

a second notch soldered to the plating on the second side edge of the printed circuit board;

a first cutout soldered to the plating on the back side of the printed circuit board; and a central opening between a first portion of the first cutout and a second portion of the first cutout;

a strain relief in the central opening of the shield;

a cable passing through the strain relief and having a first end attached to the printed circuit board; and a housing over the shield.

2. The cable adapter of claim 1 wherein the shield is formed from a single piece of conductive material.

3. The cable adapter of claim 1 wherein the shield is formed from a single piece of metal.

4. The cable adapter of claim 1 wherein the shield is formed from a single piece of stainless steel.

5. The cable adapter of claim 3 further comprising a connector attached to a second end of the cable.

6. The cable adapter of claim 5 further comprising a second connector attached to a front edge of the printed circuit board.

7. The cable adapter of claim 6 wherein the plating on the first edge, the second edge, and the back edge of the printed circuit board are ground connections.

8. A cable adapter comprising:

a cable;

a first connector at a first end of the cable;

a second connector at a second end of the cable, the second connector comprising:

a printed circuit board attached to a second end of the cable a strain relief around the second end of the cable;

a shield over the printed circuit board and a portion of the strain relief, wherein a first edge of the printed circuit board fits in a first notch on a first side of the shield and a second edge of the printed circuit board fits in a second notch on a first side of the shield, wherein the first notch and the second notch are soldered to plated areas on the printed circuit board; and a housing over the shield.

9. The cable adapter of claim 8 wherein the strain relief is attached to an end of the printed circuit board.

10. The cable adapter of claim 9 wherein a finger on the shield engages the strain relief.

11. The cable adapter of claim 8 wherein a third edge of the printed circuit board fits in a first cutout on a third side of the shield.

12. The cable adapter of claim 8 wherein the shield is formed from a single piece of conductive material.

13. The cable adapter of claim 8 wherein the shield is formed from a single piece of metal.

14. The cable adapter of claim 11 wherein the third edge of the printed circuit board is a back edge of the printed circuit board.

15. A cable adapter comprising:

a printed circuit board, the printed circuit board having plating on a first side edge and a second side edge, the first side opposing the second side;

a shield over the printed circuit board, the shield including:

a first notch soldered to the plating on the first side edge of the printed circuit board; and a second notch soldered to the plating on the second side edge of the printed circuit board;

a strain relief in a central opening of the shield;

a cable passing through the strain relief and having a first end attached to the printed circuit board; and a housing over the shield.

16. The cable assembly of claim 15 wherein the printed circuit board has plating on a back edge, the back edge adjoining the first side and the second side.

17. The cable assembly of claim 15 wherein the shield further comprises a first cutout soldered to the plating on the back side of the printed circuit board; and wherein the central opening is between a first portion of the first cutout and a second portion of the first cutout.

18. The cable adapter of claim 15 wherein the shield is formed from a single piece of metal.

19. The cable adapter of claim 18 further comprising a second connector attached to a front edge of the printed circuit board.

20. The cable adapter of claim 19 wherein the plating on the first edge, the second edge, and the back edge of the printed circuit board are ground connections.

* * * * *